US009495943B2

(12) United States Patent
Chervitz

(10) Patent No.: US 9,495,943 B2
(45) Date of Patent: Nov. 15, 2016

(54) MUSICAL INSTRUMENT

(71) Applicant: Randy J Chervitz, Studio City, CA (US)

(72) Inventor: Randy J Chervitz, Studio City, CA (US)

(73) Assignee: STRAWBONE LLC, St. Louis, MO (US)

( * ) Notice: Subject to any disclaimer, the term of this patent is extended or adjusted under 35 U.S.C. 154(b) by 267 days.

(21) Appl. No.: 14/304,697

(22) Filed: Jun. 13, 2014

(65) Prior Publication Data

US 2014/0290462 A1 Oct. 2, 2014

Related U.S. Application Data

(63) Continuation-in-part of application No. 13/853,736, filed on Mar. 29, 2013, now Pat. No. 9,105,258.

(51) Int. Cl.
*G10D 7/02* (2006.01)

(52) U.S. Cl.
CPC ..... *G10D 7/02* (2013.01)

(58) Field of Classification Search
CPC ..... G10D 7/00; G10D 9/00; G10D 9/043; G10D 7/026; G10D 7/04; G10D 3/00; G10K 5/00; A01M 31/004
USPC ..... 84/330, 380 R
See application file for complete search history.

(56) References Cited

U.S. PATENT DOCUMENTS

| | | | | |
|---|---|---|---|---|
| 2,485,142 A | | 10/1949 | Duncan | |
| 2,944,459 A | * | 7/1960 | Simmonds | G10D 7/023 84/380 C |
| 4,121,835 A | | 10/1978 | Garabedian | |
| 6,129,292 A | | 10/2000 | Leung et al. | |

* cited by examiner

*Primary Examiner* — Kimberly Lockett
(74) *Attorney, Agent, or Firm* — David H. Chervitz

(57) ABSTRACT

A musical instrument is disclosed which comprises a tubular member having an inlet end, an outlet end having a circumferential lip, an exterior surface; and an interior surface having a rib, a movable stopper member having an indentation and a rod connected to the movable stopper member, the movable stopper member and the rod for insertion within the tubular member and the movable stopper member movable between the inlet end and the circumferential lip of the tubular member along the rib.

19 Claims, 6 Drawing Sheets

MUSICAL INSTRUMENT

CROSS REFERENCE TO RELATED APPLICATIONS

This application is a continuation-in-part of U.S. patent application Ser. No. 13/853,736 filed on Mar. 29, 2013, now U.S. Pat. No. 9,105,258.

BACKGROUND

This disclosure relates generally to a musical instrument, and more particularly to a musical instrument that uses a fluid such as air to assist in generating various musical notes or tones.

Musical instruments, such as percussion instruments, wind instruments, and string instruments, are well known. In particular, musical instruments operate by producing a vibration that can be perceived by a human ear as an audible sound and interpreted as a musical note or composition. In order to produce a musical note, the musical instrument must be able to produce a vibration and sometimes amplify the vibration. All musical instruments have a sound generating mechanism that is capable of producing musical notes. For example, a drum head may be struck to produce a vibration or a string may be plucked to produce a vibration. Although such instruments are known, learning how to play and master such instruments can be a time consuming and frustrating endeavor. Further, some musical instruments are very large and are difficult to move from location to location. This may reduce the ability of a musician to practice the instrument. Other musical instruments are very expensive and may not be rented due to their expense. The expense of the instrument may hinder a musician from learning to play the instrument. In view of this, there is always a need to develop a musical instrument that is easy to learn how to play, inexpensive, and of a compact design.

The present disclosure is designed to obviate and overcome many of the disadvantages and shortcomings experienced with prior musical instruments. Moreover, the present disclosure is related to a musical instrument that can be easily manipulated or played to produce various musical notes. The musical instrument of the present disclosure is also simple to learn how to play due to the size of the musical instrument and the nature of the musical instrument.

SUMMARY

In one form of the present disclosure, a musical instrument is disclosed which comprises a tubular member having an inlet end, an outlet end having a circumferential lip, an exterior surface; and an interior surface having a rib, a movable stopper member having an indentation and a rod connected to the movable stopper member, the movable stopper member and the rod for insertion within the tubular member and the movable stopper member movable between the inlet end and the circumferential lip of the tubular member along the rib.

In another form of the present disclosure, a musical instrument comprises a tubular member having an inlet end, an outlet end having a circumferential lip, an exterior surface; and an interior surface having a first rib and a second rib, and a movable stopper member having a first indentation, a second indentation, and a rod connected to the movable stopper member, the movable stopper member and the rod for insertion within the tubular member and the movable stopper member movable between the inlet end and the circumferential lip of the tubular member along the first rib and the second rib.

In still another form of the present disclosure, a musical instrument comprises a tubular member having an inlet end, an outlet end having a circumferential lip, an exterior surface; and an interior surface having a rib, a first movable stopper member having a first thickness, an indentation formed therein, and a rod connected to the first movable stopper member, the first movable stopper member and the rod for insertion within the tubular member and the first movable stopper member movable between the inlet end and the circumferential lip of the tubular member along the rib, and a second movable stopper member having a second thickness, an indentation formed therein, and a rod connected to the second movable stopper member, the second movable stopper member and the rod for insertion within the tubular member and the second movable stopper member movable between the inlet end and the circumferential lip of the tubular member along the rib, the thickness of the first movable stopper member being greater than the thickness of the second movable stopper member.

In yet another form of the present disclosure, a musical instrument is provided which comprises an outer tubular member having an inlet end, an outlet end, an exterior surface; and an interior surface and an inner tubular member having a top end having a stopper member, an exterior surface, and a lower end, with the inner tubular member being inserted into the outer tubular member and the inner tubular member and the stopper member being movable relative to the outer tubular member.

In light of the foregoing comments, it will be recognized that the musical instrument of the present disclosure is of simple construction and design and which can be easily employed with highly reliable results.

The present disclosure provides a musical instrument that has an inner tubular member that can be displaced relative to an outer tubular member that is operable to produce various musical notes or sounds.

The present disclosure provides a musical instrument that is capable of generating various musical sounds to provide a wide variety of musical notes or compositions.

The present disclosure provides a musical instrument that is lightweight and compact.

The present disclosure also provides a musical instrument that has one moving part which is used to generate musical notes.

The present disclosure further provides a musical instrument that is compact and may easily be carried, stored, transported, inventoried, and operated.

The present disclosure provides a musical instrument that can be constructed using readily available materials.

The present disclosure also provides a musical instrument that is inexpensive.

These and other advantages of the present disclosure will become apparent after considering the following detailed specification in conjunction with the accompanying drawings, wherein:

DETAILED DESCRIPTION OF THE PREFERRED EMBODIMENTS

Figure 1:
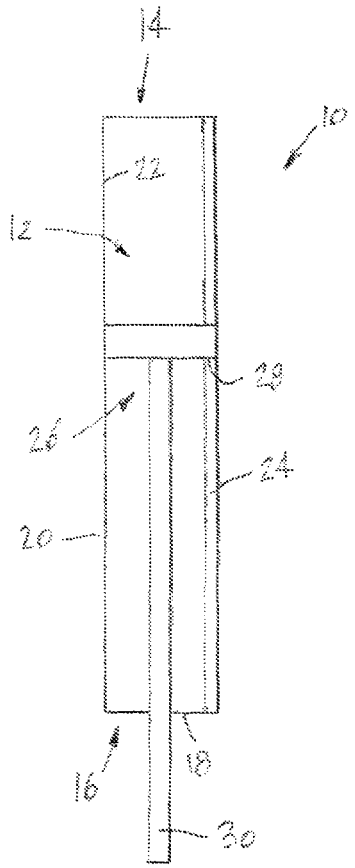
FIG. 1 is a cross-sectional view of a musical instrument constructed according to the present disclosure.

Referring now to the drawings, wherein like numbers refer to like items, number 10 identifies a preferred embodiment of a musical instrument constructed according to the present disclosure. Referring now to FIG. 1, the musical instrument 10 is shown to comprise a tubular member 12 having an inlet end 14, an outlet end 16 having a circumferential lip 18, an exterior surface 20, and an interior surface 22 having a rib 24 that extends between the inlet end 14 and the lip 18. Although the rib 24 is shown as extending between the inlet end 14 and the lip 18, it is possible that the rib 24 may only extend along a portion of the interior surface 22 of the tubular member 12. Inserted into the tubular member 12 is a movable stopper member 26 having an indentation 28 and a rod 30 connected to the movable stopper member 26. The movable stopper member 26 and the rod 30 are adapted for movement within the tubular member 12 between the inlet end 14 and the circumferential lip 18. The indentation 28 moves or rides along the rib 24 and acts as a guide for keeping the movable stopper member 26 centered within the tubular member 12. The musical instrument 10 may be operated or played by blowing air into the inlet end 14 and moving the movable stopper member 26. In particular, the movable stopper member 26 may be moved relative to the tubular member 12 and a player may blow air by or into the inlet end 14 to produce a musical note. By holding the rod 30 to move the movable stopper member 26 within the tubular member 12 various other musical notes may be generated or produced. The circumferential lip 18 acts as a stop to prevent the movable stopper member 26 from being removed from the tubular member 12 through the outlet end 16. Another hand may be used to hold the tubular member 12 about the exterior surface 20.

The tubular member 12 has a length and the rod 30 has a length. Typically, the length of the tubular member 12 is shorter than the length of the rod 30. This allows the rod 30 to extend out of the outlet end 16 of the tubular member 12. This also provides for easy grasping or handling of the rod 30 relative to the tubular member 12 so that the movable stopper member 26 can be positioned or moved within the tubular member 12 to play different notes.

Figure 2:
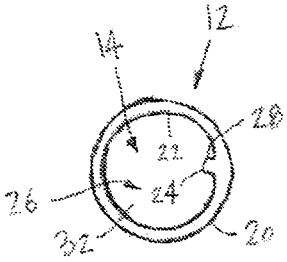
FIG. 2 is a top view or inlet end view of the musical instrument constructed according to the present disclosure.

FIG. 2 illustrates the inlet end 14 of the tubular member 12 and the movable stopper member 26 in the tubular member 12. The tubular member 12 has the inlet end 14, the exterior surface 20, and the interior surface 22. The interior surface 22 has the rib 24 thereon and the rib 24 is shown having a semicircular cross-section. The movable stopper member 26 has a top 32 and the indentation 28. The indentation 28 is shown being semicircular in shape and is complementary to the rib 24 so that the indentation 28 slides along the rib 24. Although the rib 24 and the indentation 28 are shown as being semicircular in shape, other shapes are possible and contemplated. By way of example only, an oval shape, a square shape, or a rectangular shape may be employed so long as the shapes are complementary and allow the indentation 28 to slide along or be guided by the rib 24.

Figure 3:
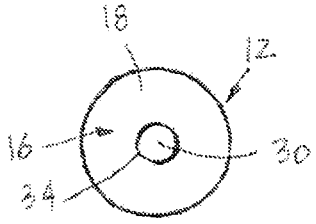
FIG. 3 is a bottom view or an outlet end view of the musical instrument constructed according to the present disclosure.

Referring now to FIG. 3, the outlet end 16 of the tubular member 12 and the rod 30 are shown. The outlet end 16 has the circumferential lip 18 and an opening 34 through which the rod 30 passes. The circumferential lip 18 acts as a stop to prevent the movable stopper member 26 from exiting the tubular member 12. This allows for continuous use of the instrument 10 without any concern of the movable stopper member 26 falling out of the instrument 10. The tubular member 12 has the exterior surface 20 which is used to be grasped by one hand of a user of the instrument 10 while another hand is used to grasp the rod 30 to control movement of the movable stopper member 26.

Figure 4:
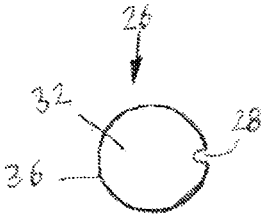
FIG. 4 is a top view of a movable stopper member removed from the musical instrument.

FIG. 4 depicts a top view of the movable stopper member 26. The movable stopper member 26 has the top 32 with the indentation 28 formed therein. The stopper member 26 has an exterior circumferential surface 36 that is adapted to contact the interior surface 22 of the tubular member 12. The movable stopper member 26 also has a diameter that is less than the diameter of the interior surface 22 of the tubular member 12. In this manner, the stopper member 26 is frictionally engaged with the interior surface 22 of the tubular member 12.

Figure 5:
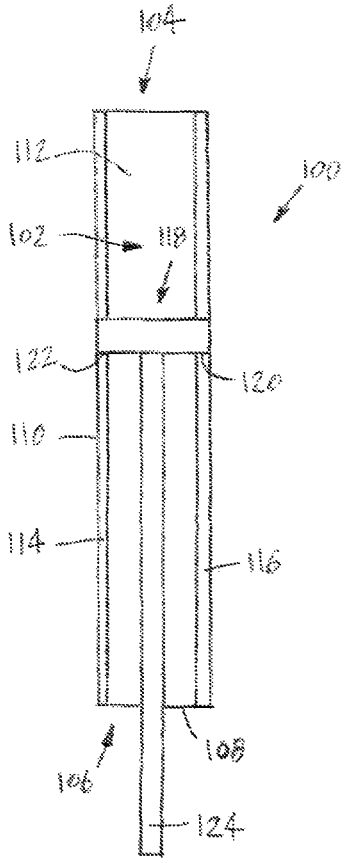
FIG. 5 is a cross-sectional view of another preferred embodiment of a musical instrument constructed according to the present disclosure.

With particular reference now to FIG. 5, another embodiment of a musical instrument 100 constructed according to the present disclosure is shown. The musical instrument 100 is shown to comprise a tubular member 102 having an inlet end 104, an outlet end 106 having a circumferential lip 108, an exterior surface 110, and an interior surface 112 having a first rib 114 and a second rib 116. Both of the ribs 114 and 116 extend between the inlet end 104 and the lip 108. Inserted into the tubular member 102 is a movable stopper member 118 having a first indentation 120, a second indentation 122, and a rod 124 connected to the movable stopper member 118. The movable stopper member 118 and the rod 124 are adapted for movement within the tubular member 102 between the inlet end 104 and the circumferential lip 108. The indentations 120 and 122 move or ride along the ribs 114 and 116. The ribs 114 and 116 act as guides for keeping the movable stopper member 118 centered within the tubular member 102. The musical instrument 100 may be operated or played by blowing air into the inlet end 104 and moving the movable stopper member 118 in an up and down fashion. In particular, the movable stopper member 118 may be moved relative to the tubular member 102 and a player may blow air by or into the inlet end 104 to produce a musical note. By holding the rod 124 to move the movable stopper member 118 within the tubular member 102 various musical notes may be generated or produced. The circumferential lip 108 acts as a stop to prevent the movable stopper member 118 from being removed from the tubular member 102 through the outlet end 106. Another hand may be used to hold the tubular member 102 about the exterior surface 110.

The tubular member 102 has a length and the rod 124 has a length. Typically, the length of the tubular member 102 is shorter than the length of the rod 124. This allows the rod 124 to extend out of the outlet end 106 of the tubular member 102 where the rod 124 can be grasped by a hand of an individual. This also provides for easy grasping or handling of the rod 124 relative to the tubular member 102 so that the movable stopper member 118 can be positioned or moved within the tubular member 102 to play different notes.

Figure 6:
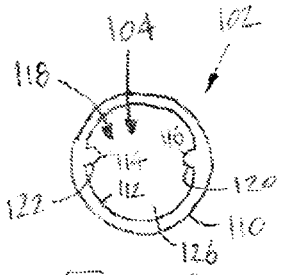
FIG. 6 is a top view or inlet end view of the musical instrument shown in FIG. 4.

FIG. 6 illustrates the inlet end 104 of the tubular member 102 and the movable stopper member 118 in the tubular member 102. The tubular member 102 has the inlet end 104, the exterior surface 110, and the interior surface 112. The interior surface 112 has the first rib 114 and the second rib 116 thereon and the ribs 114 and 116 are each shown having a semicircular cross-section. The movable stopper member 118 has a top 126 and the indentations 120 and 122. The indentations 120 and 122 are each shown being semicircular in shape and are complementary to the ribs 114 and 116 so that the indentations 120 and 122 slide along the ribs 114 and 116, respectively. Although the ribs 114 and 116 and the indentations 120 and 122 are shown as being semicircular in shape, other shapes are possible and contemplated. By way of example only, an oval shape, a square shape, or a rectangular shape may be employed so long as the shapes are complementary and allow the indentations 120 and 122 to slide along or be guided by the ribs 114 and 116.

Figure 7:
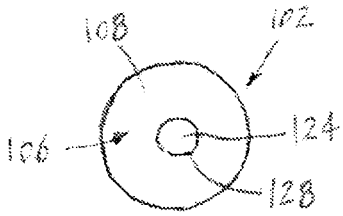
FIG. 7 is is a bottom view or outlet end view of the musical instrument shown in FIG. 4.

Referring now to FIG. 7, the outlet end 106 of the tubular member 102 and the rod 124 are shown. The outlet end 106 has the circumferential lip 108 and an opening 128 through which the rod 124 passes. The circumferential lip 108 acts as a stop to prevent the movable stopper member 118 from exiting the tubular member 102. This allows for continuous use of the instrument 100 without any concern that the movable stopper member 118 will fall or slide out of the instrument 100. The tubular member 102 has the exterior surface 110 which is used to be grasped by one hand of a user of the instrument 100 while another hand is used to grasp the rod 124 to control movement of the movable stopper member 118.

Figure 8:
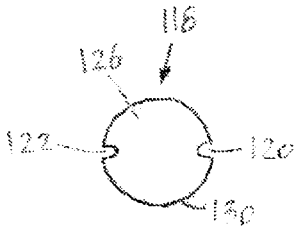
FIG. 8 is top view of a movable stopper member removed from the musical instrument.

FIG. 8 depicts a top view of the movable stopper member 118. The movable stopper member 118 has the top 126 with the indentations 120 and 122 formed therein. The stopper member 118 has an exterior circumferential surface 130 that is adapted to contact the interior surface 112 of the tubular member 102. The movable stopper member 118 also has a diameter that is less than the diameter of the interior surface 112 of the tubular member 102. In this manner, the stopper member 118 is frictionally engaged with the interior surface 112 of the tubular member 102.

Figure 9:
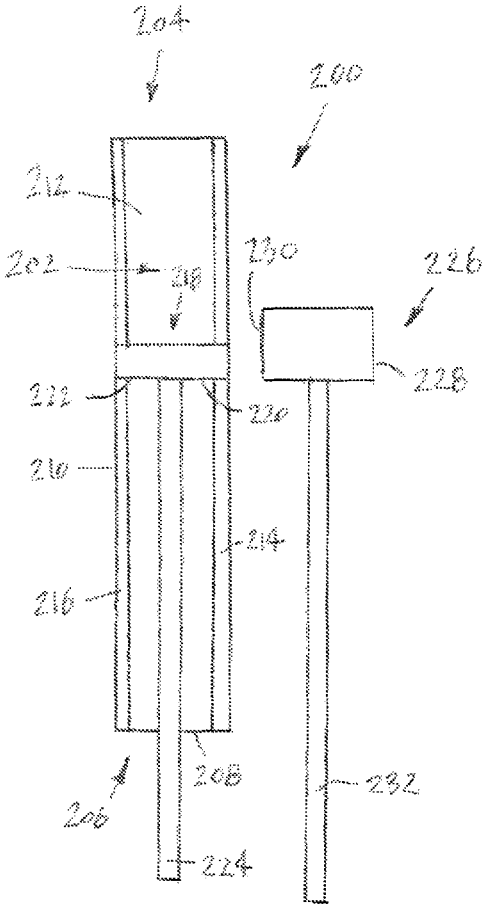
FIG. 9 is a perspective view of another embodiment of a musical instrument constructed according to the present disclosure.

With reference to FIG. 9, another embodiment 200 of the musical instrument is shown. The musical instrument 200 is shown to comprise a tubular member 202 having an inlet end 204, an outlet end 206 having a circumferential lip 208, an exterior surface 210, and an interior surface 212 having a first rib 214 and a second rib 216. Both of the ribs 214 and 216 extend between the inlet end 204 and the lip 208. Inserted into the tubular member 202 is a first movable stopper member 218 having a first indentation 220, a second indentation 222, and a rod 224 connected to the first movable stopper member 218. The first movable stopper member 218 and the rod 224 are adapted for movement within the tubular member 202 between the inlet end 204 and the circumferential lip 208. The indentations 220 and 222 move or ride along the ribs 214 and 216. The ribs 214 and 216 act as guides for keeping the first movable stopper member 218 centered within the tubular member 202. The musical instrument 200 also has a second movable stopper member 226 having a first indentation 228, a second indentation 230, and a rod 232 connected to the second movable stopper member 226. The second movable stopper member 226 and the rod 232 are adapted for movement within the tubular member 202 between the inlet end 204 and the circumferential lip 208. The indentations 228 and 230 move or ride along the ribs 214 and 216. The ribs 214 and 216 act as guides for keeping the second movable stopper member 226 centered within the tubular member 202. The first movable stopper member 218 has a thickness and the second movable stopper member 226 has a thickness and the thickness of the second movable stopper member 226 is greater than the thickness of the first movable stopper member 218. The difference in thicknesses allows different sounding notes to be played with the first movable stopper member 218 compared to the second movable stopper member 226. For example, lower sounding or bass notes may be played with the second movable stopper member 226 as compared to the first movable stopper member 218. Also, it is possible that the rod 232 may be longer than the rod 224. This provides better control of the second movable stopper member 226.

The musical instrument 200 may be operated or played by blowing air into the inlet end 204 and moving the first movable stopper member 218 or the second movable stopper member 226 in an up and down fashion. The first movable stopper member 218 or the second movable stopper member 226 may be moved relative to the tubular member 202 while a player is blowing air by or into the inlet end 204 to produce a musical note. By holding the rod 224 to move the first movable stopper member 218 within the tubular member 202 various musical notes may be generated or produced. Also, a player of the musical instrument 200 may quickly remove the first movable stopper member 218 and replace it with the second movable stopper member 226 during a performance when other sounding notes are desired. The circumferential lip 208 acts as a stop to prevent the first movable stopper member 218 or the second movable stopper member 226 from being removed from the tubular member 202 through the outlet end 206. As can be appreciated, another hand may be used to hold the tubular member 202 about the exterior surface 210 during use of the musical instrument 200.

Figure 10:
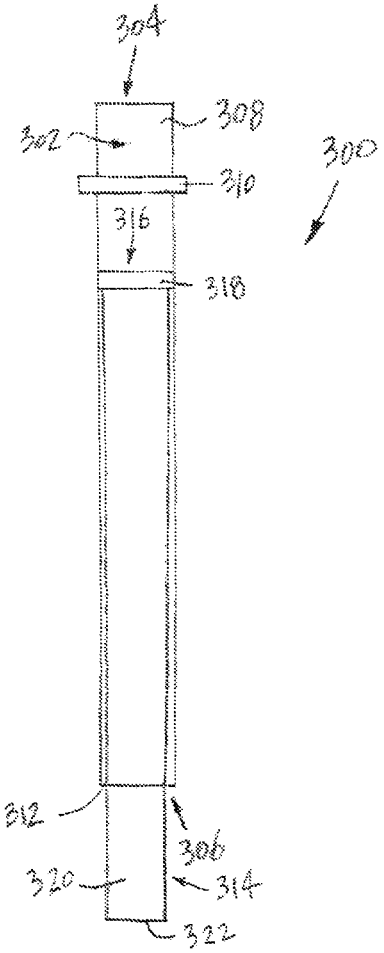
FIG. 10 is a perspective view of still another embodiment of a musical instrument constructed according to the present disclosure.

FIG. 10 illustrates another embodiment of a musical instrument 300 constructed according to the present disclosure. The musical instrument 300 comprises an outer tubular member 302 having an inlet end 304, an outlet end 306, an exterior surface 308 having an outer circumferential rib 310, and an interior surface 312. The outer circumferential rib 310 is adapted to be grasped by an individual playing the musical instrument 300. Although the rib 310 is shown, it is also possible that the exterior surface 308 may not include the rib 310. An inner tubular member 314 has a top end 316 having a stopper member 318, an exterior surface 320, and a lower end 322. The inner tubular member 314 is adapted to fit within the outer tubular member 302 and the inner tubular member 314 may be moved relative to the outer tubular member 302. The stopper member 318 is wider than the tubular member 314 and this prevents air from passing from the inlet end 304 through the outer tubular member 302 and out the outlet end 306. In this manner, air is contained within the outer tubular member 302 between the inlet end 304 and the stopper member 318. The stopper member 318 may be formed of any material, such as rubber, plastic, or felt, that allows the stopper member 318 to slide within the outer tubular member 302 while at the same time preventing air from escaping through the outlet end 306.

The musical instrument 300 may be operated or played by blowing air into the inlet end 304 and moving the inner tubular member 314 and the stopper member 318 in an up and down motion. The stopper member 318 may be moved relative to the outer tubular member 302 while a player is blowing air by or into the inlet end 304 to produce a musical note. By grasping the inner tubular member 314 to move the stopper member 318 within the outer tubular member 302 various musical notes may be generated or produced. One hand may be used to hold the outer tubular member 302 at the outer circumferential rib 310 during use of the musical instrument 300. The stopper member 318 is frictionally engaged with the interior surface 312 of the outer tubular member 302. Although not shown, it is possible that the outer tubular member 302 may have a circumferential lip at the outlet end 306 to hold the stopper member 318 and the inner tubular member 324 within the outer tubular member 302. If it further contemplated that one or more ribs may be provided along the interior surface 312 of the outer tubular member 302.

Preferably, the musical instruments 10, 100, 200, and 300 will be constructed of a relatively lightweight material so that it can be easily handled and played. By way of example only, the musical instruments 10, 100, 200, and 300 may be constructed of a tubing such as PVC (polyvinyl chloride) tubing, plastic, wood, metal, polymer clay, plastic, glass, carbon fiber, or ceramic. The tubular members 12, 102, 202, 302, and 314 may be straight to facilitate a smooth motion when moving the stopper members 26, 118, 218, 226, and 318 within the members 12, 102, 202, and 302 respectively. Although the tubular members 12, 102, 202, 302, and 314 have been depicted having a circular cross-section, it is also possible that the cross-sections may take on other shapes. Again, by way of example only, an oval cross-section, an egg shaped cross-section, or a rectangular cross-section may be used. It is also contemplated that the tubular members 12, 102, 202, 302, and 314 may be clear, colored, or have a pattern or a logo printed thereon or incorporated therein. As can be appreciated, the other elements, such as the movable stopper members 26, 118, 218, 226, and 318 may also be clear, colored, or have a pattern or logo printed thereon or incorporated therein.

From all that has been said, it will be clear that there has thus been shown and described herein a musical instrument which fulfills the various objects and advantages sought therefor. It will be apparent to those skilled in the art, however, that many changes, modifications, variations, and other uses and applications of the subject musical instrument are possible and contemplated. All changes, modifications, variations, and other uses and applications which do not depart from the spirit and scope of the disclosure are deemed to be covered by the disclosure, which is limited only by the claims which follow.

What is claimed is:

1. A musical instrument comprising:

a tubular member having an inlet end, an outlet end having a circumferential lip, an exterior surface; and an interior surface having a rib; and a movable stopper member having an indentation and a rod connected to the movable stopper member, the movable stopper member and the rod for insertion within the tubular member and the movable stopper member movable between the inlet end and the circumferential lip of the tubular member along the rib.

2. The musical instrument of claim 1 wherein tubular member has a length and the rod has a length with the length of the rod being greater than the length of the tubular member.

3. The musical instrument of claim 1 wherein the indentation is adapted to fit around the rib.

4. The musical instrument of claim 1 wherein the rib has a length that spans between the inlet end and the circumferential lip.

5. The musical instrument of claim 1 wherein the circumferential lip has a circular opening and the rod is adapted to fit through the circular opening.

6. The musical instrument of claim 1 wherein the movable stopper member has a length and the tubular member has a length and the length of the movable stopper member is less than the length of the tubular member.

7. A musical instrument comprising:

a tubular member having an inlet end, an outlet end having a circumferential lip, an exterior surface; and an interior surface having a first rib and a second rib; and a movable stopper member having a first indentation, a second indentation, and a rod connected to the movable stopper member, the movable stopper member and the rod for insertion within the tubular member and the movable stopper member movable between the inlet end and the circumferential lip of the tubular member along the first rib and the second rib.

8. The musical instrument of claim 7 wherein the movable stopper member has a flat upper surface.

9. The musical instrument of claim 7 wherein tubular member has a length and the rod has a length with the length of the rod being greater than the length of the tubular member.

10. The musical instrument of claim 7 wherein the first indentation is adapted to fit around the first rib and the second indentation is adapted to fit around the second rib.

11. The musical instrument of claim 7 wherein the first rib has a length that spans between the inlet end and the circumferential lip.

12. The musical instrument of claim 7 wherein the circumferential lip has a circular opening and the rod is adapted to fit through the circular opening.

13. The musical instrument of claim 7 wherein the movable stopper member has a length and the tubular member has a length and the length of the movable stopper member is less than the length of the tubular member.

14. The musical instrument of claim 7 wherein the tubular member has a diameter and the movable stopper member has a diameter with the diameter of the tubular member being greater than the diameter of the movable stopper member.

15. The musical instrument of claim 7 wherein the second rib has a length that spans between the inlet end and the circumferential lip.

16. A musical instrument comprising:

an outer tubular member having an inlet end, an outlet end, an exterior surface, and an interior surface; and an inner tubular member having a top end having a stopper member, an exterior surface, and a lower end, with the inner tubular member being inserted into the outer tubular member and the inner tubular member and the stopper member being movable relative to the outer tubular member and wider than the inner tubular member to prevent air from passing from the inlet end through the outer tubular member and out the outlet end.

17. The musical instrument of claim 16 wherein the movable stopper member frictionally engages the interior surface of the outer tubular member.

18. The musical instrument of claim 16 wherein the stopper member is formed of a material that allows the stopper member to slide within the outer tubular member and prevents air from escaping through the outlet end.

19. The musical instrument of claim 16 further comprising an outer circumferential rib on the exterior surface.

* * * * *